US006695541B1

(12) United States Patent
Spence

(10) Patent No.: US 6,695,541 B1
(45) Date of Patent: Feb. 24, 2004

(54) MODULAR DOCK SYSTEM AND METHOD OF CONSTRUCTION

(76) Inventor: Jeffrey E. Spence, 4020 Mertins Dr., Nashotah, WI (US) 53058

( * ) Notice: Subject to any disclaimer, the term of this patent is extended or adjusted under 35 U.S.C. 154(b) by 0 days.

(21) Appl. No.: 09/711,694

(22) Filed: Nov. 13, 2000

(51) Int. Cl.[7] ..... E02B 3/20; E02B 3/26

(52) U.S. Cl. ..... 405/218; 405/211; 405/219; 405/215; 114/263; 52/177; 52/263

(58) Field of Search ..... 405/4.5, 211, 211.1, 405/215, 218–220, 221; 52/87, 177, 263, 300, 301, 796.1; 114/263, 264, 265, 266, 267, 219

(56) References Cited

U.S. PATENT DOCUMENTS

| | | | | |
|---|---|---|---|---|
| 3,094,848 A | | 6/1963 | Albrecht | |
| 3,282,919 A | * | 11/1966 | Hahn | 405/218 |
| 3,875,707 A | | 4/1975 | Horn | |
| 3,914,913 A | * | 10/1975 | Roberts | 52/475.1 |
| 3,999,397 A | | 12/1976 | Albery | |
| 4,037,420 A | * | 7/1977 | Wicks | 405/218 |
| 4,074,537 A | * | 2/1978 | Gronlie | 405/218 |
| 4,078,515 A | * | 3/1978 | Svirklys | 405/219 X |
| 4,212,564 A | * | 7/1980 | Kay | 405/218 |
| 4,260,293 A | * | 4/1981 | Peterson | 405/219 |
| 4,352,597 A | * | 10/1982 | Kay | 405/219 |
| 4,398,849 A | | 8/1983 | Moran et al. | |
| 4,920,907 A | * | 5/1990 | Richter | 114/219 |
| 4,923,336 A | | 5/1990 | Schmidt | |
| 4,948,300 A | | 8/1990 | Bateson | |
| 4,964,760 A | * | 10/1990 | Hartmann | 405/215 |
| 5,009,045 A | * | 4/1991 | Yoder | 52/177 |
| 5,048,448 A | * | 9/1991 | Yoder | 114/263 |
| 5,412,915 A | * | 5/1995 | Johnson | 52/177 |
| 5,617,689 A | * | 4/1997 | Beane | 52/177 X |
| 5,642,592 A | * | 7/1997 | Andres | 52/177 |
| 5,788,416 A | * | 8/1998 | Wolgamot | 405/218 |
| 5,819,491 A | * | 10/1998 | Davis | 52/177 X |
| 6,021,994 A | * | 2/2000 | Shartzer, Jr. | 249/6 |
| 6,095,074 A | * | 8/2000 | Reinhardt | 405/215 |
| 6,128,880 A | * | 10/2000 | Meenan, Jr. | 52/263 X |
| 6,194,051 B1 | * | 2/2001 | Gagas et al. | 52/263 X |
| 6,233,886 B1 | * | 5/2001 | Andres | 405/218 X |

FOREIGN PATENT DOCUMENTS

| | | | | |
|---|---|---|---|---|
| WO | 88/03107 | * | 5/1988 | 405/219 |

OTHER PUBLICATIONS

Brock Dock Brochure, Brock Manufacturing, P.O. Box 2000, Milford, IN 46542, undated.
Brock Dock Brochure, Brock Manufacturing, P.O. Box 2000, Milford, IN, 46542, 1990.

* cited by examiner

*Primary Examiner*—Jong-Suk James Lee
(74) *Attorney, Agent, or Firm*—Boyle, Fredrickson, Newholm, Stein & Gratz, S.C.

(57) ABSTRACT

A dock or pier assembly is constructed of a series of substantially identical dock modules. The dock modules are preferably rectangular in shape, and a post and bracket support arrangement is provided at each corner of each dock module for supporting the dock modules above a body of water. Each dock module includes a frame assembly, constructed of a series of metal frame members welded together to define a rigid frame. A series of deck members are mounted to the frame, and may be in the form of extruded plastic deck members. Each side frame member includes an upper flange to which a connector strip is secured, and the connector strip defines engagement structure for mounting the deck members to the side frame members. Each frame member of the frame assembly further includes a vertical web and a lower flange. A bumper or cover member is secured to the vertical web of each frame member, for providing a finished appearance and for protecting the web and lower flange when in use. The dock modules are relatively simple in construction and are easy to install in a body of water and to remove from the body of water for seasonal storage. The configuration of the assembled dock modules can be varied and expanded according to user requirements, providing a flexible and adaptable dock or pier assembly.

27 Claims, 4 Drawing Sheets

MODULAR DOCK SYSTEM AND METHOD OF CONSTRUCTION

BACKGROUND AND SUMMARY OF THE INVENTION

This invention relates to a dock or pier assembly for use in a body of water.

Many types of dock and pier structure are well known for use in a body of water such as a lake, river, ocean front, or the like. Some such structures are "permanent", i.e. intended to be left in place year round, while others are removable so as to enable the structure to be installed for periods of use, such as during warm weather months, and removed when not in use, such as during cold weather months. In either case, installation of a dock or pier structure can be a laborious and time consuming task.

It is an object of the present invention to provide a dock or pier structure which provides quick and easy installation and which requires minimal maintenance. It is a further object of the invention to provide a dock or pier structure consisting of a number of identically constructed modules, to facilitate off-site manufacture. A still further object of the invention is to provide such a dock or pier assembly in which the modules can be arranged in various configurations according to the requirements of the end user. A still further object of the invention is to provide a module for constructing a dock or pier assembly, in which the module is relatively light weight and is formed of components which provide a high degree of strength and resistance to the elements. Yet another object of the invention is to provide such a dock module which is relatively simple in its components and construction and which is affordable and easy to install. A still further object of the invention is to provide a method of constructing a dock or pier assembly utilizing a series of dock modules.

In accordance with the invention, a dock or pier assembly, for use in a body of water, is formed of a series of substantially identically constructed dock modules which are interconnected to form a dock or pier assembly having a desired configuration. Each dock module includes a structural frame assembly, and deck structure engaged with the structural frame assembly. The dock modules are arranged to form a dock assembly, and a series of support members are engaged with the dock modules for supporting the dock modules above the water.

The frame assembly of each dock module preferably includes a pair of side frame members and a pair of transverse end frame members which extend between and interconnect the side frame members. In preferred form, the end and side frame members are structural metal members, formed of a material such as aluminum or steel, welded together at their ends to form a strong, rigid frame assembly.

The deck structure of each dock module is preferably in the form of a series of deck members secured to the frame members. The deck members define a pair of spaced ends, each of which is located over one of the side frame members. A connector member, such as a connector strip, is secured to each side frame member, and each deck member is secured to a connector strip toward one of the ends defined by the deck member. The deck members may be in the form of extruded plastic deck planks having an underside formed with mounting structure which is engaged by the connector strips, so as to secure the deck planks to the frame assembly.

Each side frame member includes an upstanding web and upper and lower flanges extending from upper and lower ends, respectively, defined by the web. Each connector strip is secured to the upper flange of one of the side frame members. The dock module further includes a bumper member engaged with the web of each side frame member. The bumper member may be the form of an elongated plastic member located above the lower flange of each side frame member. Each bumper member is secured to the web of one of the side frame members above the lower flange, by means of an adhesive and/or a mechanical fastening arrangement.

The dock modules can be arranged singly or in an end-to-end manner to form dock sections, with support members located at the abutting ends of adjacent dock modules for supporting the dock modules above the water. The dock sections can be arranged in various configurations, to form a dock structure having a size and shape according to the requirements of the end user. The support members may be in the form of conventional dock support posts and brackets, and are preferably arranged to support the corners of each dock module.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
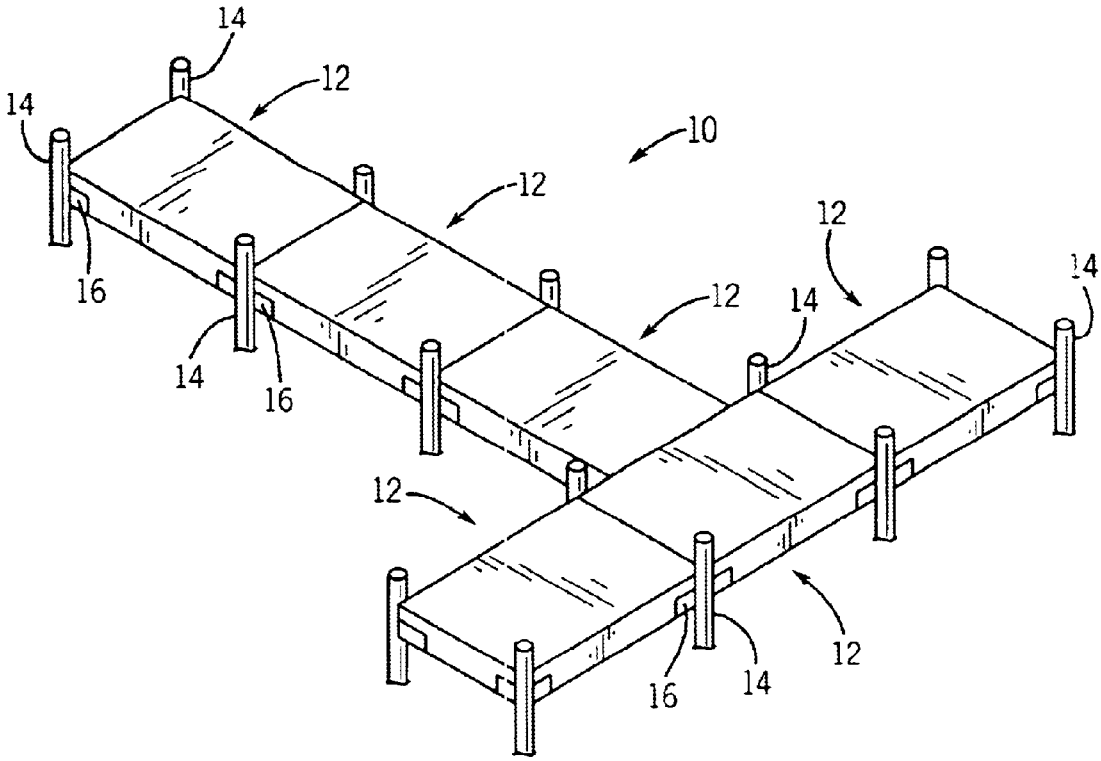
FIG. 1 is an isometric view of a series of assembled dock modules constructed according to the invention for forming a dock or pier assembly for use in a body of water.

FIG. 1 illustrates a dock or pier assembly 10 constructed utilizing a series of dock modules 12 made in accordance with the invention. Dock modules 12 are supported by a series of support members in the form of support posts 14 and brackets 16, which support dock modules 12 above a body of water. Posts 14 and brackets 16 are of conventional construction, and are typically employed in forming a dock, or pier assembly having a wood frame construction. Representatively, posts 14 may be such as are available from Norlen, Inc. of Schofield, Wis. under its part number TD20039, although other parts numbers representing various post lengths may be employed. Posts 14 are commonly provided with post covers, and brackets 16 may be such as are available from Norlen, Inc. of Schofield, Wis. under its part numbers TD10001 (outside corner), TD10002 (inside corner), TD10003 (straight) and TD20037 (inside cover three-way).

Figure 2:
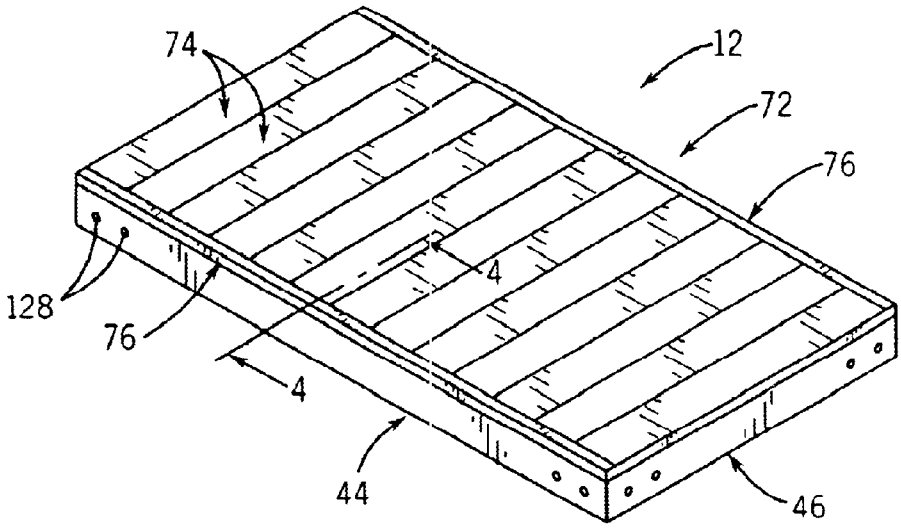
FIG. 2 is an isometric view of a dock module used in forming a dock or pier assembly such as is illustrated in FIG. 1.
Figure 3:
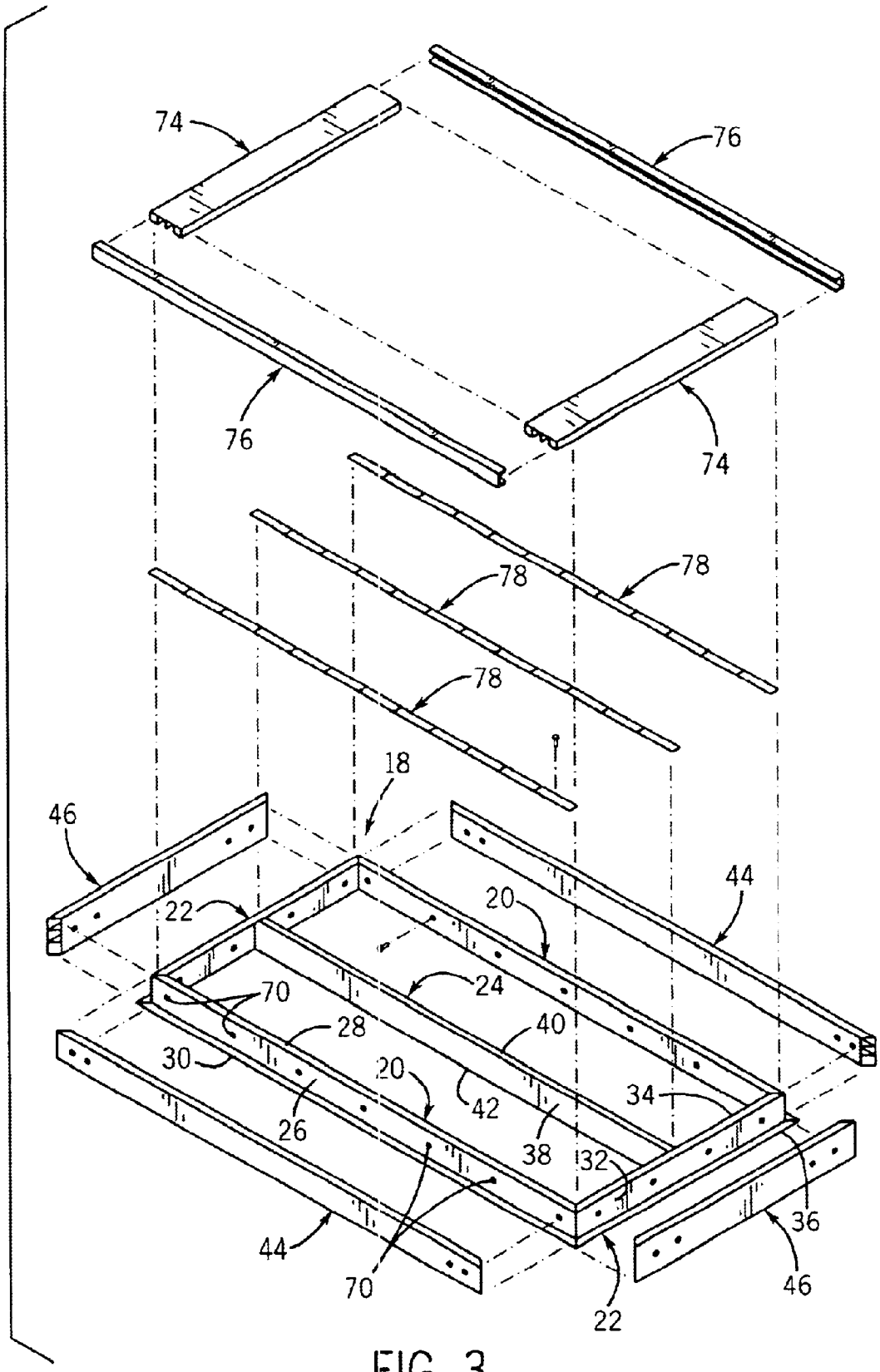
FIG. 3 is an exploded isometric view of the dock module in FIG. 2.

Referring to FIGS. 2 and 3, each dock module 12 includes a frame assembly 18 including a pair of side frame members 20 and a pair of end frame members 22. A longitudinal stringer member 24 extends between end frame members 22 and is oriented parallel to side frame members 20. Side frame members 20, end frame members 22 and stringer member 24 may be structural metal frame members, formed of a material such as aluminum, galvanized steel, or stainless steel, although it is understood that other metallic or non-metallic materials may be employed. As illustrated, side frame members 20, end frame members 22 and stringer member 24 are identical in construction, defining a Z-shaped cross section. It is understood, however, that other structural forms may be used, such as channel sections, I-sections, H-sections, or the like. It is also understood that side frame members, 20, end frame members 22 and stringer member 24 need not be identical in construction, and that the relative sizes and cross sections may vary one from the other.

In the illustrated embodiment, the adjoining ends of each side frame member 20 and end frame member 22 are mitered and connected together such as by welding. Similarly, each end of stringer member 24 abuts and is connected to one of end frame members 22, such as by welding. Again, it is understood that side frame members 20, end frame members 22 and stringer member 24 may be connected together other than by welding, such as by use of brackets and/or mechanical fasteners or the like.

As noted above, side frame members 20, end frame members 22 and stringer members 24 each preferably have a Z-shaped cross section. Each side frame member 20 includes an upright, a web 26, a laterally extending upper flange 28 extending inwardly from the upper end of web 26, and a laterally extending lower flange 30 extending outwardly from the lower end of web 26. Similarly, each end frame member 22 includes a web 32, an upper flange 34 and a lower flange 36, and stringer member 24 includes a web 38, an upper flange 40 and a lower flange 42. At the joint between each side frame member 20 and each end frame member 22, the respective webs 26, 32, upper flanges 28, 34 and lower flanges 30, 36 are mitered and welded together. As shown, frame assembly 18 has a rectangular configuration, although it understood that other configurations, such as parallelogram or trapezoidal configurations, may be employed.

A side bumper or cover member 44 is secured to each side frame member. 20 and an end cover member 46 is secured to each end frame member 22. The adjacent ends of side cover members 44 and end cover members 46 are beveled so as to define mitered joints therebetween at the corners of dock module 12. Side cover members 44 and end cover members 46 do not contribute significantly to the strength of frame assembly 18, but rather provide a finished outward appearance for dock module 12 and also function to protect webs 26, 30 and lower flanges 30, 36 of side and end frame members 20, 22, respectively, against damage. Representatively, side cover members 44 and end cover members 46 may be formed of an extruded plastic material, such as is used in plastic fencing, and is available from Royal Crown Limited of Milford, Ind. under its designation Triple Crown Fence.

Figure 4:
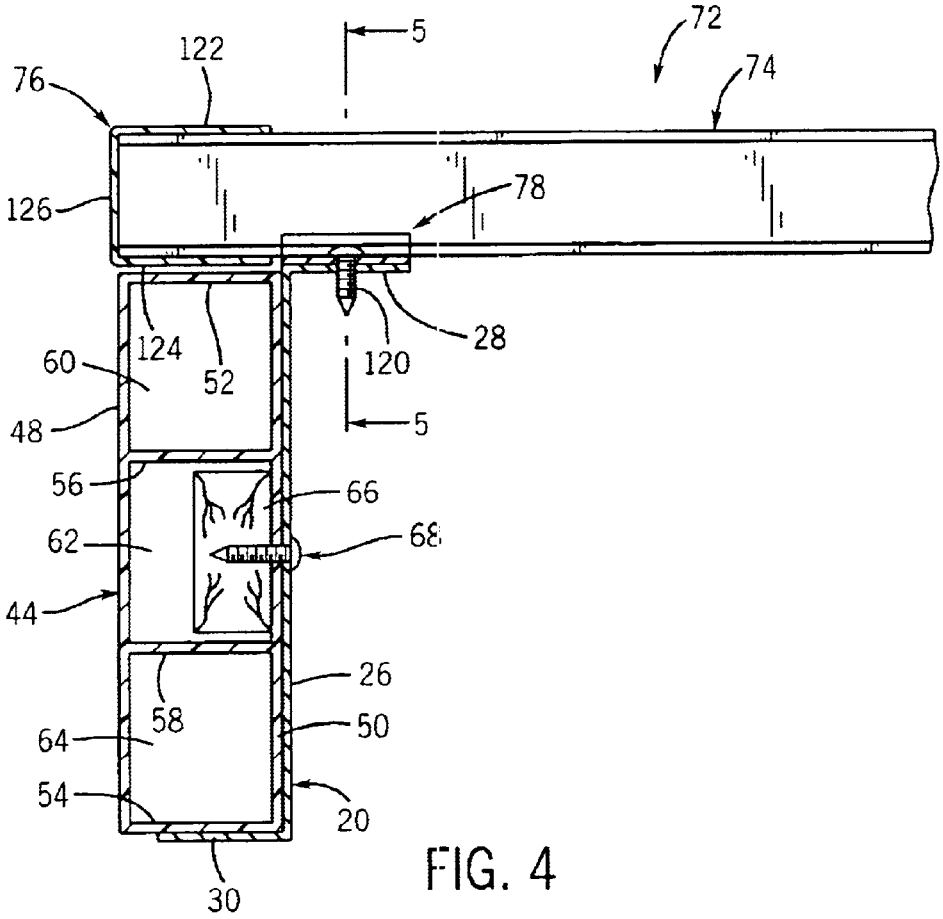
FIG. 4 is a partial section view taken along line 4—4 of FIG. 2.

In the illustrated embodiment, side cover members 44 and end cover members 46 are identical in cross-section, and FIG. 4 illustrates the manner in which side cover members 44 and end cover members 46 are secured to side and end frame members 20, 22, respectively.

As shown in FIG. 4, side cover member 44 defines an outer wall 48, an inner wall 50, a top wall 52 and a bottom wall 54, which cooperate to form a rectangular cross-section. A pair of transverse walls 56, 58 extend between outer wall 48 and inner wall 50, and are oriented parallel to top and bottom walls 52, 54, respectively. Transverse walls 56, 58 separate the internal space of side cover member 44 into an upper passage 60, a central passage 62 and a lower passage 64.

Side cover member 44 is sized such that its height is generally equal to the height of web 26 between upper flange 28 and lower flange 30. Side cover member 44 is engaged with side frame member 20 such that bottom wall 54 of cover member 44 rests on and is supported by lower flange 30, and inner wall 50 engages the outer surface of web 26.

Side cover member 44 is secured to side frame member 20 by means of a wooden strip 66 and a series of fasteners such as screws 68. Wooden strip 66 has a length only slightly less than that of side cover member 44, and is received within central passage 62 between transverse walls 56, 58. A series of apertures 70 are formed in side frame member 20, and a screw 68 extends through each aperture 70 and through an aligned aperture in inner wall 50 of side cover member 44, into engagement with wooden strip 66. Tightening of screws 68 draws strip 66 toward and against the inside surface of side cover member inner wall 50, to clamp or sandwich inner wall 50 and web 26 between strip 66 and the head of each screw 68. In addition, a marine adhesive is applied between the outer surface of web 26 and the outwardly facing surface of side cover member inner wall 50, such that side cover member 44 is secured to side frame member 20 by a combination of the marine adhesive and the mechanical fastening and engagement arrangement provided by strip 66 and screws 68.

It should be understood that the illustrated and described embodiment is but one means for mounting side cover member 44 to side frame member 20, and that other satisfactory mounting arrangements may be employed. In addition, it is understood that end cover members 46 are secured to end frame members 22 in the same manner as shown and described with respect to mounting of side cover members 44 to side frame members 20.

As shown, side cover members 44 and end cover members 46 define a transverse dimension greater than that of lower flanges 30, 36, respectively, so as to extend outwardly beyond the outer edges of lower flanges 30, 36, respectively. In this manner, side and end cover members 44, 46 function to both conceal and protect lower flanges 30, 36, respectively.

Figure 5:
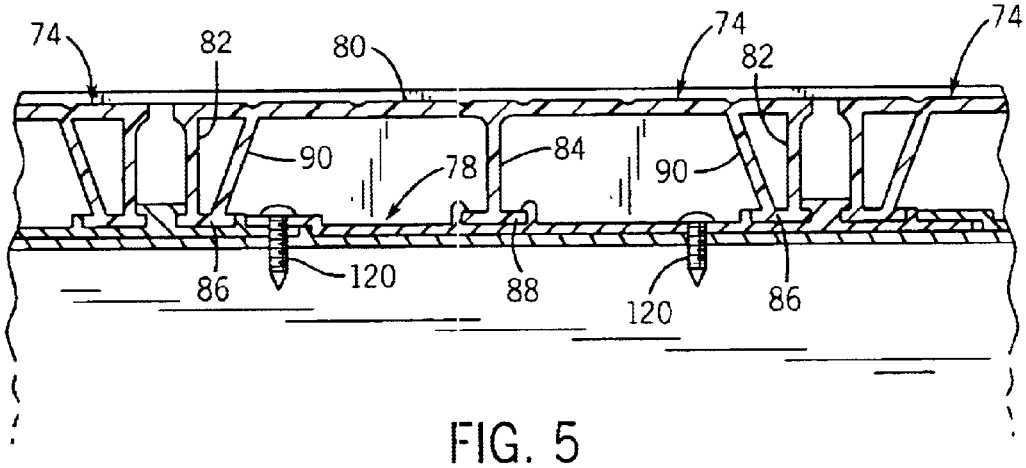
FIG. 5 is a partial section view taken along line 5—5 of FIG. 4.
Figure 6:
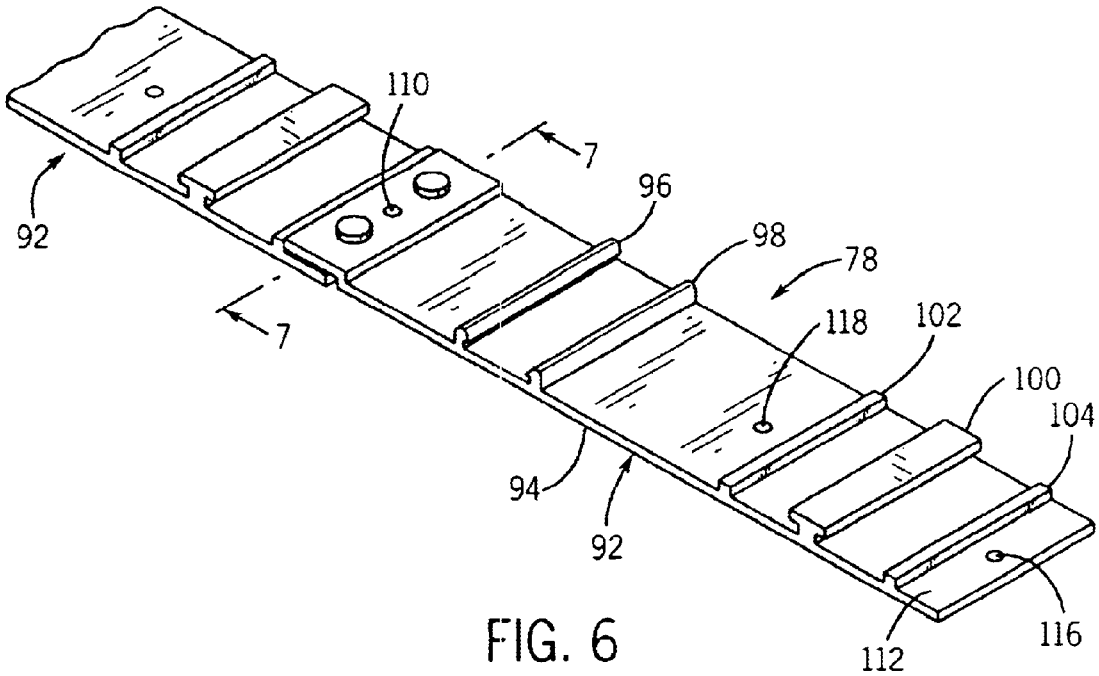
FIG. 6 is a partial isometric view of a section of a connector strip utilized in constructing the dock module of FIGS. 2 and 3.
Figure 7:
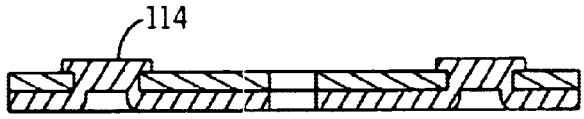
FIG. 7 is a section view taken along line 7—7 of FIG. 6.
Figure 8:
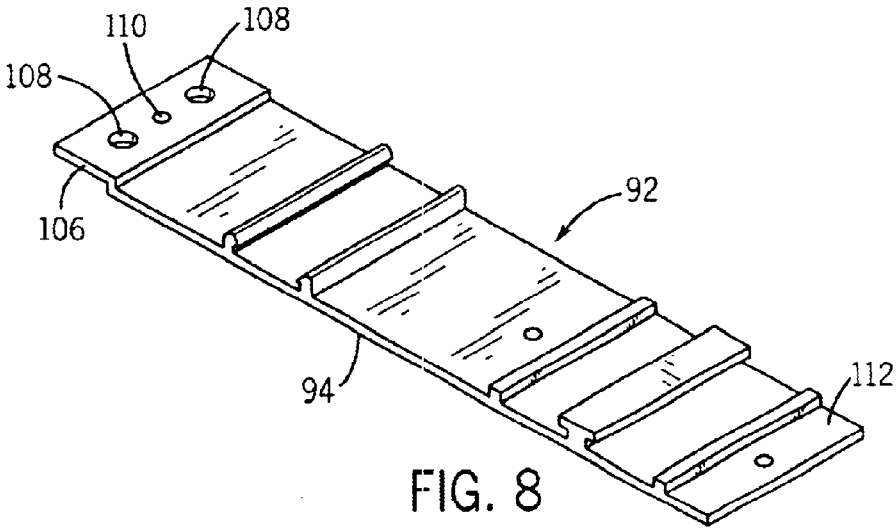
FIG. 8 is an isometric view of a section of the connector strip of FIG. 6.

With reference to FIGS. 3–5, frame assembly 18 supports a deck structure, shown generally at 72. Deck structure 72 generally includes a series of deck members 74 which extend between side frame members 20, a pair of end caps 76, and a pair of connector strips 78 which are operable to secure deck members 74 to side frame members 20. Deck members 74 and end caps 76 may be such as is available from Royal Crown Limited of Milford, Ind. under its designation BROCK DECK.

Each deck member 74 defines a length greater than the spacing between side frame members 20, such that the ends of deck members 74 extend beyond side frame members 20 and overlie side cover members 44, as shown in FIG. 4.

Referring to FIG. 5, each deck member 74 includes an upper wall 80 supported by a pair of end legs 82 and a central leg 84. An end foot 86 is formed at the lower end of each end leg 82, and a central foot 88 is formed at the lower end of central leg 84. An angled reinforcing web 90 extends between each end foot 86 and upper wall 80. Deck members 74 are preferably formed of an extruded thermoplastic material such as PVC, although it is understood that other materials and forming methods may be employed.

Referring to FIGS. 5–8, each connector strip 78 is formed of a series of connector strip sections 92 connected together in an end-to-end manner. Each connector strip section defines a flat horizontal base 94 having engagement structure on its upper surface adapted to receive and engage feet 86, 88 defined by each deck member 74. The engagement structure includes a pair of facing hook members 96, 98, and a T-shaped member 100 located between a pair of ridges 102, 104. One end of base 94 defines a vertically offset connector section 106 having a pair of connection apertures 108 and a mounting aperture 110 located therebetween.

The end mounting section 106 of each connector strip section 92 overlies an end area 112 of the adjacent connector strip section 92. Using a conventional punch press or the like, the material of end area 112 in alignment with connection apertures 108 is formed into apertures 108 and defines a head 114 (FIG. 7) which overlies connector section 106 outwardly of the edges of connection apertures 108, to secure adjacent connector strips sections 92 together. It should be understood, however, that connector strip sections 92 may be secured together in any other satisfactory manner, and that connector strip 78 may be formed of a 1-piece construction. As shown and described, each connector strip section 92 is formed of an extruded metallic material, such as aluminum, which resists corrosion and is lightweight and easily formed. Again, however, it is understood that other satisfactory materials and forming methods may be employed.

In addition to mounting aperture 110 in connector section 106, each connector strip section 92 also includes a mounting aperture 116 in end area 112 and a mounting aperture 118 formed in base 94 adjacent ridge 102. Mounting aperture 110 of each connector strip section 92 overlies mounting aperture 116 of an adjacent mounting strip section 92 when mounting sections 92 are connected together. A self-tapping fastener, such as a conventional zip screw 120 (FIGS. 4, 5), extends through each aperture 118 and aligned set of apertures 110, 116 into engagement with upper flange 128 of one of side frame members 20, for securing each connector strip 78 to one of side frame members 20. Connector strips 78 extend throughout the length of side frame members 20, and connector strips 78 and deck members 74 are sized such that the outer edge of each end one of deck members 74 is in alignment with the underlying end cover member 46 secured to end frame member 22.

As shown in FIG. 5, one side of each T-shaped member 100 cooperates with one of ridges 102, 104 to engage an end foot 86 of one of deck members 74. Hook members 96 are arranged so as to overlie and engage the ends of central foot 88 of one of deck members 74. Typically, feet 86, 88 of each deck member 74 are installed using a rubber mallet or the like, and the material of deck member 74 is sufficiently flexible and resilient to enable feet 86, 88 to deflect an amount sufficient to amount to enable the edges of feet 86, 88 to engage the rigid engagement structure defined by T-shaped members 100 and hook members 96.

With the above-described mounting structure and method, deck members 74 are frictionally and securely engaged with side frame members 20 of frame assembly 18. If desired, a connector strip 78 may also be applied to stringer member 24 so as to provide a further connection of deck members 74 to frame assembly 18. Once deck members 74 are installed in this manner, end cap 76 is secured over the ends of deck members 74 such that an upper wall 122 of end cap 76 overlies the end of upper wall 80 of each deck member 74 and a bottom wall 124 of end cap 76 overlaps and engages the underside of each deck member 74. A vertical end wall 126 extends between upper wall 122 and bottom wall 124 outwardly of the ends of deck members 74, such that end cap 76 overlies and encloses the ends of deck members 74.

The above construction provides a finished deck module 12 having a predetermined size and shape, such as 4' wide by 8' long although other sizes may be employed. Referring to FIG. 2, a set of openings 128 are formed adjacent to each end of side cover member 44 and a set of openings 130 are formed adjacent each end of each end cover member 46, to provide a set of four openings at each corner of deck module 12. Aligned openings are formed in webs 26, 32 of side frame members 20 and end frame members 22, respectively, so as to receive conventional mounting pins for securing each corner of dock module 12 to one of brackets 16. With this arrangement, dock modules 12 can be positioned in any desired configuration, such as that illustrated in FIG. 1, with a post 14 and bracket 16 located at each corner of each dock module 12 for supporting dock modules 12 in the desired configuration above a body of water.

The uniform construction of dock modules 12 facilitates ease of manufacture by use of appropriate assembly jigs and fixtures and the like, and also provides for efficient storage and shipment. Dock modules 12 are easily assembled in various configurations, which can be quickly and simply changed by an end user by altering the locations of posts 14 and brackets 16. In addition, the dock or pier assembly 10 may be expanded without difficulty, again simply by altering the number and configuration of dock modules 12 used in combination with posts 14 and brackets 16.

The dock or pier assembly 10 is also easy to disassemble when required, such as for off-season removal from the body of water, simply by reversing the above described installation steps.

Various alternatives and embodiments are contemplated as being within the scope of the following claims particularly pointing out and distinctly claiming the subject matter regarded as the invention.

I claim:

1. A dock assembly for use in a body of water, comprising:

a series of substantially identically constructed preassembled dock modules, wherein each of the dock modules includes a preassembled frame constructed of a pair of side frame members and a pair of end frame members, wherein the ends of adjacent side frame members and end frame members are rigidly connected together to define a rectangular shape of the frame, wherein each dock module further includes a series of deck members secured to and carried by the frame and a series of bumper members secured to and carried by the frame, wherein the bumper members comprise a pair of side bumpers secured one to each side frame member and a pair of end bumpers secured one to each end frame member, wherein each of the side and end frame members includes at least one opening located adjacent each of its ends and wherein each side bumper and each end bumper includes an opening in alignment with the opening in the respective side frame member and end frame member, and wherein the dock modules are adapted to be arranged so as to form a dock, wherein the deck members define opposed ends, each of which extends outwardly of one of the side frame members, and wherein each side bumper member is located below the ends of the deck members on one side of the dock module; and a series of support members for supporting the dock modules above the water, wherein the support members are arranged such that each corner of each dock module is supported by one of the support members, and wherein each support member is engaged with at least one of the frame member openings at a corner of the frame to connect the support member and the dock module together.

2. The dock assembly of claim 1, wherein the deck structure comprises a series of deck members, and further comprising a deck connector member secured to each of the spaced side frame members, wherein the deck connector member includes engagement structure for engaging the series of deck members for connecting the deck members to the frame, and wherein the ends of the deck members one each side of the dock module extend outwardly of the deck connector member.

3. The dock module of claim 1, wherein each side bumper underlies the ends of the deck members on one side of the dock module and extends throughout the length of the dock module side, and wherein the side bumper is configured such that an outwardly facing surface defined by the side bumper is generally coplanar with an outwardly facing end surface defined by the end of each deck member such that, when a pair of dock modules are positioned together in a side-by-side manner, the side bumpers of the dock modules face each other and the end surfaces of the deck members of the dock modules are located adjacent each other to provide a continuous upwardly facing surface defined by the deck members of the dock modules.

4. The dock module of claim 3, wherein the deck members include a pair of endmost deck members, each of which overlies one of the end frame members and includes an outer portion that extends outwardly of the end frame member, wherein each end bumper underlies the outer portion of one of the endmost deck members, and wherein the end bumper is configured such that an outwardly facing surface defined by the end bumper is generally coplanar with an outwardly facing side surface defined by the endmost deck member such that, when a pair of dock modules are positioned together in an end-to-end manner, the end bumpers of the dock modules face each other and the side surfaces of the deck members of the dock modules are located adjacent each other to provide a continuous upwardly facing surface defined by the deck members of the dock modules.

5. A dock assembly for use in a body of water, comprising:

a series of substantially identically constructed preassembled dock modules, wherein each of the dock modules includes a preassembled frame constructed of a pair of side frame members and a pair of end frame members, wherein the ends of adjacent side frame members and end frame members are rigidly connected together to define a rectangular shape of the frame, wherein each dock module further includes a series of deck members secured to and carried by the frame and a series of bumper members secured to and carried by the frame, wherein the bumper members comprise a pair of side bumpers secured one to each side frame member and a pair of end bumpers secured one to each end frame member, wherein each of the side and end frame members includes at least one opening located adjacent each of its ends and wherein each side bumper and each end bumper includes an opening in alignment with the opening in the respective side frame member and end frame member, and wherein the dock modules are adapted to be arranged so as to form a dock;

wherein each of the side frame members and end frame members includes an upstanding web, a lower flange extending outwardly from a lower end defined by the web, and an upper flange extending from an upper end defined by the web, and wherein the side bumpers and end bumpers are secured to the upstanding webs of the side frame members and end frame members, respectively, wherein each bumper is engaged with the upstanding web of the frame member above the lower flange of the frame member; and a series of support members for supporting the dock modules above the water, wherein the support members are arranged such that each corner of each dock module is supported by one of the support members, and wherein each support member is engaged with at least one of the frame member openings at a corner of the frame to connect the support member and the dock module together.

6. The dock assembly of claim 5, wherein each bumper includes an axially extending passage, and wherein each bumper is engaged with the web of one of the frame members by means of a strip member located within the passage of the bumper, and one or more threaded fasteners extending through the web of the frame member and through a wall defined by the bumper and into engagement with the strip member.

7. The dock assembly of claim 6, further comprising an adhesive located between the wall of the bumper and an outer surface of the web of the frame member with which the wall of the bumper is engaged.

8. The dock assembly of claim 6, wherein the bumper defines a lower wall supported by the outwardly extending lower flange of the frame member.

9. A dock assembly for use in a body of water, comprising:

a series of substantially identically constructed preassembled dock modules, wherein each of the dock modules includes a preassembled frame constructed of a pair of side frame members and a pair of end frame members, wherein the ends of adjacent side frame members and end frame members are rigidly connected together to define a rectangular shape of the frame, wherein each dock module further includes a series of deck members secured to and carried by the frame and a series of bumper members secured to and carried by the frame, wherein the bumper members comprise a pair of side bumpers secured one to each side frame member and a pair of end bumpers secured one to each end frame member, wherein each of the side and end frame members includes at least one opening located adjacent each of its ends and wherein each side bumper and each end bumper includes an opening in alignment with the opening in the respective side frame member and end frame member, and wherein the dock modules are adapted to be arranged so as to form a dock;

a deck connector member secured to each of the spaced side frame members, wherein the deck connector member includes engagement structure for engaging the series of deck members for connecting the deck members to the frame, wherein each of the pair of spaced side frame members includes a web and a flange extending from an upper end defined by the web, wherein one of the deck connector members is secured to the flange of each of the pair of spaced side frame members; and a series of support members for supporting the dock modules above the water, wherein the support members are arranged such that each corner of each dock module is supported by one of the support members, and wherein each support member is engaged with at least one of the frame member openings at a corner of the frame to connect the support member and the dock module together.

10. The dock assembly of claim 9, wherein each of the deck connector members comprises a connector strip extending along and secured to the flange of one of the side frame members.

11. The dock assembly of claim 10, wherein the connector strip includes a series of engagement members, wherein the engagement members are constructed and arranged to engage at least a pair of mounting tabs defined by one of the deck members.

12. The dock assembly of claim 11 wherein the connector strip comprises a series of connector strip sections secured to each other in an end-to-end fashion.

13. A dock module for constructing a dock assembly for use in a body of water, comprising:

a series of rigidly interconnected frame members configured to form a rigid rectangular frame, wherein the frame members comprise a pair of side frame members and a pair of end frame members, wherein each of the side and end frame members defines an outwardly facing wall;

deck structure secured to and carried by the frame; and a series of bumper members extending along and secured to each frame member, wherein the bumper members comprise a pair of side bumper members and a pair of end bumper members, wherein each side bumper member is located outwardly of and is secured to the outwardly facing wall of one of the side frame members and each end bumper member is located outwardly of and is secured to the outwardly facing wall of one of the end frame members, wherein each bumper member defines an inner wall that faces and engages the outwardly facing wall of the frame member to which the bumper member is secured;

wherein the deck structure comprises a series of deck members that extend between the side frame members, wherein each deck member defines a pair of opposed ends, and wherein the deck members are arranged such that the ends of the deck members on each side of the dock module extend outwardly of the side frame member, and wherein each side bumper member underlies the ends of the deck members on one of the sides of the dock module;

wherein the frame, the deck members and the bumper members are preasssembled together to form a unitary dock module, and wherein a plurality of the preassembled dock modules are adapted to be arranged in a predetermined configuration and connected together and supported above the body of water by a series of support members, wherein the bumper members are configured such that, when the dock modules are connected together, the facing bumper members of the adjacent dock modules engage each other and the deck structures of the adjacent dock modules define a continuous and uninterrupted deck surface.

14. The dock module of claim 13, wherein each of the support members includes a bracket arrangement with which each of the dock modules is adapted for engagement, for supporting the dock modules above the body of water, and wherein each of the dock modules includes connection structure for connecting the dock module to the bracket arrangement of one of the support members.

15. The dock module of claim 14, wherein the connection structure comprises one or more openings located adjacent each of a pair of spaced ends defined by each of the frame members, wherein each of the openings is adapted to receive a connector adapted for engagement with the bracket arrangement for connecting the dock module to one of the support members adjacent each end defined by each frame member.

16. The dock module of claim 13, wherein each side bumper member underlies the ends of the deck members on one side of the dock module and extends throughout the length of the dock module side, and wherein the side bumper member is configured such that an outwardly facing surface defined by the side bumper member is generally coplanar with an outwardly facing end surface defined by the end of each deck member such that, when a pair of dock modules are positioned together in a side-by-side manner, the side bumper members of the dock modules face each other and the end surfaces of the deck members of the dock modules are located adjacent each other to provide a continuous upwardly facing surface defined by the deck members of the dock modules.

17. The dock module of claim 16, wherein the deck members include a pair of endmost deck members, each of which overlies one of the end frame members and includes an outer portion that extends outwardly of the end frame member, wherein each end bumper member underlies the outer portion of one of the endmost deck members, and wherein the end bumper member is configured such that an outwardly facing surface defined by the end bumper member is generally coplanar with an outwardly facing side surface defined by the endmost deck member such that, when a pair of dock modules are positioned together in an end-to-end manner, the end bumper members of the dock modules face each other and the side surfaces of the deck members of the dock modules are located adjacent each other to provide a continuous upwardly facing surface defined by the deck members of the dock modules.

18. The dock module of claim 15, A dock module for constructing a dock assembly for use in a body of water, comprising:

a series of rigidly interconnected frame members configured to form a rigid rectangular frame, wherein the frame members comprise a pair of side frame members and a pair of end frame members, wherein each of the side and end frame members defines an outwardly facing wall;

deck structure secured to and carried by the frame; and a series of bumper members extending along and secured to each frame member, wherein the bumper members comprise a pair of side bumper members and a pair of end bumper members, wherein each side bumper member is located outwardly of and is secured to the outwardly facing wall of one of the side frame members and each end bumper member is located outwardly of and is secured to the outwardly facing wall of one of the end frame members, wherein each bumper member defines an inner wall that faces and engages the outwardly facing wall of the frame member to which the bumper member is secured;

wherein each of the frame members includes an upstanding web that defines the outwardly facing wall of the frame member, and wherein each bumper member is engaged with the web of one of the frame members and extends throughout the length of the frame member;

wherein the frame, the deck structure and the bumper members are preasssembled together to form a unitary dock module, and wherein a plurality of the preassembled dock modules are adapted to be arranged in a predetermined configuration and connected together and supported above the body of water by a series of support members, wherein the bumper members are configured such that, when the dock modules are connected together, the facing bumper members of the adjacent dock modules engage each other and the deck structures of the adjacent dock modules define a continuous and uninterrupted deck surface.

19. The dock module in claim 18, wherein each of the frame members includes a lower flange extending outwardly from a lower end defined by the web, wherein the bumper member is located above the lower flange.

20. The dock module of claim 19, wherein each of the side frame members further includes an upper flange extending from an upper end defined by the web, and further comprising a deck connector strip secured to the upper flange of each of the side frame members, wherein the deck structure includes a series of transverse deck members engaged with the deck connector strips throughout the length of the dock module.

21. A method of constructing a dock assembly for use in a body of water, comprising of the steps of:

providing a series of substantially identically constructed preassembled rectangular dock modules, wherein each of the dock modules includes: a pair of side frame members and a pair of end frame members that are rigidly connected together to define a rigid rectangular frame; deck structure secured to and carried by the rigid rectangular frame, wherein the deck structure comprises a series of deck members defining spaced apart ends, wherein the deck member ends are located outwardly of the side frame members; and a pair of side bumpers and a pair of end bumpers, wherein each side bumper is secured to one of the side frame members at a location below the ends of the deck members and is configured such that an outwardly facing surface defined by the side bumper is generally coplanar with an end surface defined by each of the ends of the deck members, and wherein each end bumper is secured to one of the end frame members at a location below the deck structure;

positioning a support member in the body of water in the vicinity of each corner of each dock module; and engaging each corner of each dock module with one of the support members, wherein the support members are positioned such that the dock modules are supported at their corners and are configured to form a predetermined dock assembly configuration when engaged with the support members;

wherein the deck structure, the end bumpers and the side bumpers of adjacent dock modules are configured such that the facing bumpers of adjacent dock modules face each other when the dock modules are positioned together, and wherein the deck structure of the dock modules is configured to define a continuous deck surface when the dock modules are positioned together.

22. The method of claim 21, wherein the step of positioning a series of support members in the body of water is carried out by positioning a series of upright supports in the body of water, wherein each of the upright supports includes a bracket arrangement.

23. The method of claim 22, wherein the step of engaging the dock modules with the upright supports is carried out by engaging each of the dock modules with one of the bracket arrangements of one of the upright supports adjacent a corner defined by the dock module.

24. The method of claim 23, wherein the step of engaging the dock modules with the upright supports is carried out by forming an opening in each of the frame members of each of the dock modules, and engaging a connector member with a bracket of one of the upright supports and positioning the connector member within one of the openings.

25. The method of claim 21, wherein the deck members include a pair of endmost deck members, each of which overlies one of the end frame members and includes an outer portion that extends outwardly of the end frame member, wherein each end bumper underlies the outer portion of one of the endmost deck members, and wherein the end bumper is configured such that an outwardly facing surface defined by the end bumper is generally coplanar with an outwardly facing side surface defined by the endmost deck member such that, when a pair of dock modules are positioned together in an end-to-end manner, the end bumpers of the dock modules face each other and the side surfaces of the deck members of the dock modules are located adjacent each other to provide a continuous upwardly facing surface defined by the deck members of the dock modules.

26. A method of constructing a dock assembly for use in a body of water, comprising of the steps of:

providing a series of substantially identically constructed preassembled rectangular dock modules, wherein each of the dock modules includes: a pair of side frame members and a pair of end frame members that are rigidly connected together to define a rigid rectangular frame: deck structure secured to and carried by the rigid rectangular frame; and a pair of side bumpers and a pair of end bumpers, wherein each side bumper is secured to one of the side frame members at a location below the deck structure and wherein each end bumper is secured to one of the end frame members at a location below the deck structure;

positioning a support member in the body of water in the vicinity of each corner of each dock module, wherein the step of positioning the support members in the body of water is carried out by positioning a series of upright supports in the body of water, wherein each of the upright supports includes a bracket arrangement; and engaging each corner of each dock module with one of the support members, wherein the support members are positioned such that the dock modules are supported at their corners and are configured to form a predetermined dock assembly configuration when engaged with the support members, wherein the step of engaging the dock modules with the upright supports is carried out by engaging each of the dock modules with one of the bracket arrangements of one of the upright supports adjacent a corner defined by the dock module, and further includes forming an opening in each of the frame members of each of the dock modules, and engaging a connector member with a bracket of one of the upright supports and positioning the connector member within one of the openings, wherein each of the frame members includes a web, and wherein the step of forming an opening in each of the frame members is carried out by forming one or more openings in the web of each of the frame members;

wherein the deck structure, the end bumpers and the side bumpers of adjacent dock modules are configured such that the facing bumpers of adjacent dock modules engage each other when the dock modules are positioned together, and wherein the deck structure of the dock modules is configured to define a continuous deck surface when the dock modules are positioned together.

27. The method of claim 26, wherein each of the frame members includes a lower flange extending outwardly from a lower end defined by the web, and wherein the step of securing the bumper member to the web is carried out by positioning the bumper member above the lower flange.

* * * * *